US005302976A

United States Patent [19]

Sugahara et al.

[11] Patent Number: 5,302,976

[45] Date of Patent: Apr. 12, 1994

[54] LOW-VOLTAGE ACTUATABLE INK DROPLET EJECTION DEVICE

[75] Inventors: Hiroto Sugahara, Aichi; Masahiko Suzuki, Nagoya; Yoshikazu Takahashi, Kasugai, all of Japan

[73] Assignee: Brother Kogyo Kabushiki Kaisha, Aichi, Japan

[21] Appl. No.: 888,793

[22] Filed: May 27, 1992

[30] Foreign Application Priority Data

May 30, 1991 [JP] Japan ..... 3-127486
May 30, 1991 [JP] Japan ..... 3-127487
May 31, 1991 [JP] Japan ..... 3-129441

[51] Int. Cl.[5] ..... B41J 2/045
[52] U.S. Cl. ..... 346/140 R
[58] Field of Search ..... 346/140 R; 310/333; B41J 2/045

[56] References Cited

U.S. PATENT DOCUMENTS 4,879,568 11/1989 Bartky et al. ..... 346/140 R
4,887,100 12/1989 Michaelis et al. ..... 346/140 R
4,929,256 5/1990 Shepherd ..... 51/293
4,940,996 7/1990 Paton et al. ..... 346/140 R
4,942,409 7/1990 Paton et al. ..... 346/140 R
4,973,981 11/1990 Bartky et al. ..... 346/1.1
4,992,808 2/1991 Bartky et al. ..... 346/140 R
5,003,679 4/1991 Bartky et al. ..... 29/25.35
5,016,028 5/1991 Temple ..... 346/140 R
5,028,936 7/1991 Bartky et al. ..... 346/140 R
5;144,342 9/1992 Kubota ..... 346/140 R

FOREIGN PATENT DOCUMENTS 0258550 11/1991 Japan .

*Primary Examiner*—Benjamin R. Fuller
*Assistant Examiner*—Alrick Bobb
*Attorney, Agent, or Firm*—Oliff & Berridge

[57] ABSTRACT

An ink droplet ejection array is assembled by a piezoelectric transducer and a plate member. The piezoelectric transducer has a surface formed with a plurality of ribs which define a plurality of grooves. The plate member is attached to the surface of the piezoelectric transducer to cover the grooves and to thus define a plurality of ink channels. Ink contained in the ink channel is ejected when the volume of the ink channel is instantaneously reduced resulting from deformation of the associated ribs. The plate member is flexible to the deformation of the ribs so as not to restrain the deformation thereof.

5 Claims, 4 Drawing Sheets

LOW-VOLTAGE ACTUATABLE INK DROPLET EJECTION DEVICE

BACKGROUND OF THE INVENTION

1. Field of the Invention

The present invention relates to an ink droplet ejection device, and more particularly to an ejection device for ejecting ink droplets utilizing deformation of a piezoelectric transducer.

2. Description of the Prior Art

A piezoelectric ink jet printing head has recently been proposed in the art. In the printing head known as a drop-on-demand type, ink contained in an ink channel is ejected in the form of droplet from an orifice when the volume of the ink channel is reduced resulting from deformation of a piezoelectric transducer, and the ink is supplemented into the ink channel from a valve opposite an orifice plate when the volume of the ink channel is increased. A multiplicity of such ejection units are closely juxtaposed so that a desired character or image is formed by ejecting ink droplets from selected ejection units.

An ink droplet ejection device of the type described above is disclosed in U.S. Pat. Nos. 4,992,808, 5,003,679 and 5,028,936. FIGS. 1 and 2 show an arrangement of such a conventional ejection device. As shown, an ejector array is made up of a piezoelectric ceramic wafer 1 and a cover plate 21. The piezoelectric ceramic wafer 1 has an inner surface formed with a plurality of ribs 2*a*, 2*b*, 2*c*, 2*d* extending in parallel to one another. Metal electrodes 11*c*, 11*d* are separately formed on the surface of the rib 2*b*. Likewise, metal electrodes 11*e*, 11*f* are also separately formed on the surface of the rib 2*c*. The piezoelectric wafer 1 has been polarized in the direction indicated by an arrow 51. The cover plate 21 is made of metal, glass or ceramic. The cover plate 21 is face-to-face bonded to the piezoelectric ceramic wafer 1 through an adhesive layer 12, thereby forming a plurality of ink channels 31*a*, 31*b*, 31*c* arranged in a horizontal direction. Each of the ink channels has a rectangular cross-section. The ribs defining the ink channel are deformable in a direction perpendicular to both the ink channel extending direction and the polarization direction, i.e., in the direction transversal to the direction in which the ink channels extend.

To eject an ink droplet from, for example, the ink channel 31*b* in accordance with print data, electric fields are applied between the metal electrodes 11*c* and 11*d* and between the metal electrodes 11*e* and 11*f*. Since the direction in which the electrical field is applied is orthogonal to the polarization direction of the piezoelectric ceramic wafer 1, the ribs 2*b* and 2*c* are deformed inwardly of the ink channel 31*b* pursuant to piezoelectric thickness shear effect. Due to the deformation of the ribs 2*b* and 2*c*, the volume of the ink channel 31*b* is reduced and thus the ink pressure is increased, causing to eject an ink droplet from an orifice 42 (see FIG. 2) formed on an orifice plate 41. When the application of the electric fields are stopped, the ribs 2*b*, 2*c* are restored to the original states, whereat ink is supplemented into the ink chamber 31*b* from an ink reservoir utilizing the fact that the ink pressure in the ink channel is reduced at the time of restoration of the ribs 2*b*, 2*c*.

Next, the manufacturing process of the ejector array will be described with reference to FIG. 2. The piezoelectric ceramic wafer 1 which has been polarized in the direction of arrow 51 is ground by a rotary diamond cutting disc to form U-shaped grooves 3 serving as ink channels. Metal electrodes are formed on the surfaces of the ribs by way of spattering. Thereafter, the cover plate 21 is bonded to the top faces 4*a* of the ribs. The orifice plate 41 is then bonded to the side face 4*b* of the piezoelectric ceramic wafer 1 so that the orifices 42 are in alignment with the ink channel positions.

The conventional ink droplet ejection array thus constructed is involved with a problem that a high driving voltage is required for ejecting the ink droplets. This is due to the fact that the deformation of the ribs is restrained by the cover plate bonded to one side of the transducer. Therefore, the ribs cannot be deformed as desired if it is driven with a low driving voltage.

SUMMARY OF THE INVENTION

The present invention has been made to solve the problem accompanying the conventional ejector device. Accordingly, it is an object of the present invention to provide an ink droplet ejection device which can be driven at a lower voltage.

To achieve the above and other objects, the present invention provides an ink droplet ejection device which includes a piezoelectric transducer and a plate member. The piezoelectric transducer has a surface formed with a plurality of ribs which define a plurality of grooves. The plate member is attached to the surface of the piezoelectric transducer to cover the plurality of grooves and to thus define a plurality of ink channels. Each ink channel has a volume for containing ink therein, and the volume of the ink channel is changed when corresponding ribs are deformed. The feature of the present invention resides in that the plate member is flexible to deformation of any one of the ribs so as not to restrain the deformation thereof.

In one embodiment of the invention, the plate member has a plurality of portions corresponding to respective ones of the plurality of grooves individually. The portions are curved inwardly of each ink channel so as to be readily inwardly buckled when the volume of the ink channel is reduced resulting from the deformation of associated ribs.

In another embodiment of the invention, the plate member is a dual plate structure having a first plate element having a first surface bonded to the surface of the piezoelectric transducer to cover the grooves and a second surface, and a second plate element having a surface fixedly attached to the second surface of the first plate element. The first plate element is made of a material having a modulus of elasticity lower than a material of said second plate member.

In still another embodiment of the invention, the piezoelectric transducer has side walls having a height higher than a height of the ribs, wherein the plate member is fixedly attached to the side walls of the piezoelectric transducer so as to have a space between each rib and the plate member. The height of the space is equal to or less than one fifth of a full height of each of the ink channels.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
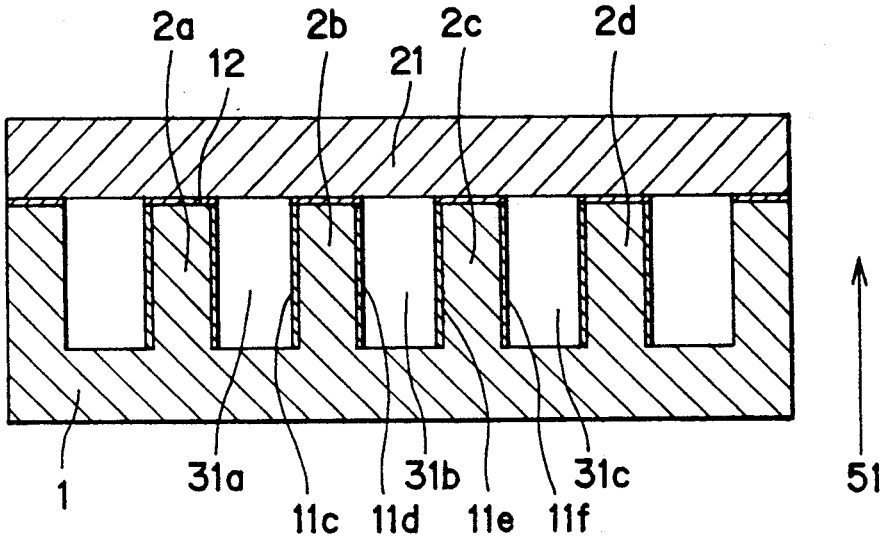
FIG. 1 PRIOR ART
FIG. 1 is a cross-sectional view showing a part of a conventional ink droplet ejection device.
Figure 2:
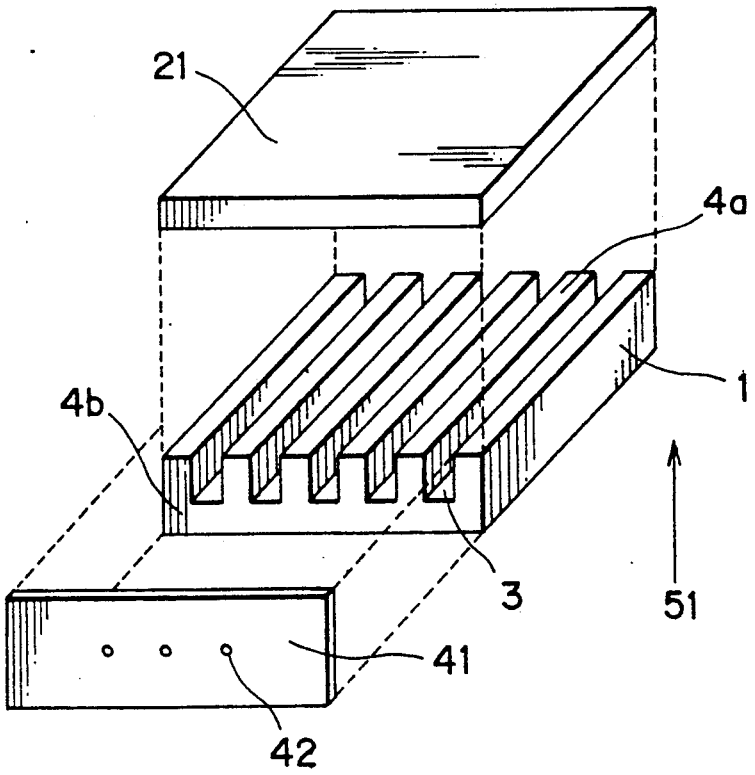
FIG. 2 PRIOR ART
FIG. 2 is a perspective view illustrating a manufacturing steps of the conventional ink droplet ejection device.

The same reference numerals used in FIGS. 1 and 2 will be used throughout the figures to denote the same or corresponding components.

Figure 3:
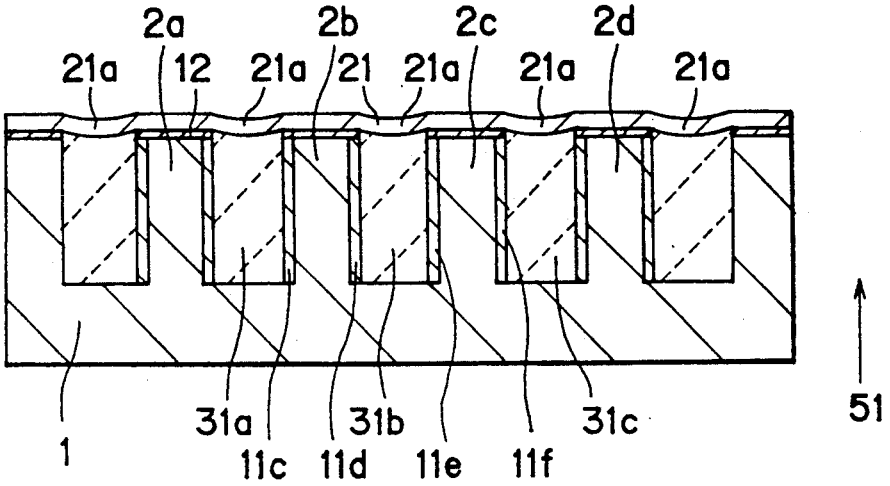
FIG. 3 is a cross-sectional view showing a part of an ejector array according to a first embodiment of the present invention.

A first embodiment of the present invention will be described with reference to FIGS. 3 and 4.

Similar to the conventional ejector array, the array of the first embodiment is made up of a piezoelectric ceramic wafer 1 and a cover plate 21, and the piezoelectric ceramic wafer 1 has an inner surface formed with a plurality of space apart ribs 2*a*, 2*b*, 2*c*, 2*d* extending in parallel to one another. Metal electrodes 11*c*, 11*d* are separately formed on the surface of the rib 2*b* by way of spattering. Likewise, metal electrodes 11*e*, 11*f* are separately formed on the surface of the rib 2*c*. The piezoelectric wafer 1 has been polarized in the direction indicated by an arrow 51.

The cover plate 21 is made of metal or resin. The cover plate 21 has a corrugated cross-section and is bonded to top surfaces of the ribs through an adhesive layer 12. Inwardly protruded portions of the cover plate 21 are positioned above the grooves formed on the piezoelectric ceramic wafer 1 to thus define ink channels. The ink channels 31*a*, 31*b*, 31*c* having a rectangular cross-section extend in a direction perpendicular to the sheet of drawing and are arranged in the horizontal direction. The ribs defining the ink channel are deformable in a direction perpendicular to both the ink channel extending direction and the polarization direction, i.e., in the direction transversal to the direction in which the ink channels extend.

Figure 4:
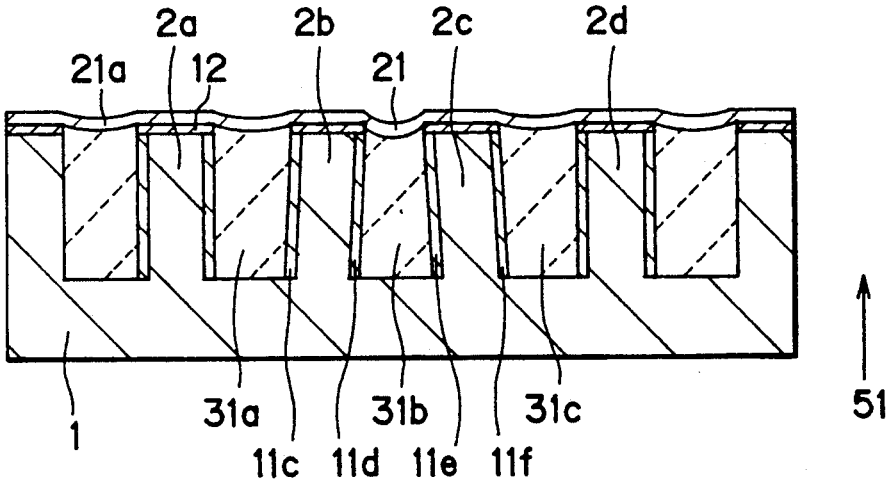
FIG. 4 is a cross-sectional view showing deformation of the ejector array shown in FIG. 3 when a driving voltage is applied thereto.

When an electric field is developed between the metal electrodes 11*c* and 11*d* and between the metal electrodes 11*e* and 11*f*, the ribs 2*b* and 2*c* are deformed as illustrated in FIG. 4, causing to eject an ink droplet from the ejection device 31*b*.

Since the cover plate 21 is corrugated so as to have inwardly curved portions 21*a* corresponding to the ink channels, the cover plate 21 is easily buckled inwardly of the ink channels when the corresponding ribs are deformed. The cover plate 21 exerts less restraining force upon the ribs when the latter are deformed. In addition, the volume in the ink channel is further reduced as a result of the inward buckling of the cover plate 21 buckled toward inside of the ink channel 21. Therefore, ejection of the ink droplet can be implemented with a lower voltage.

Figure 5:
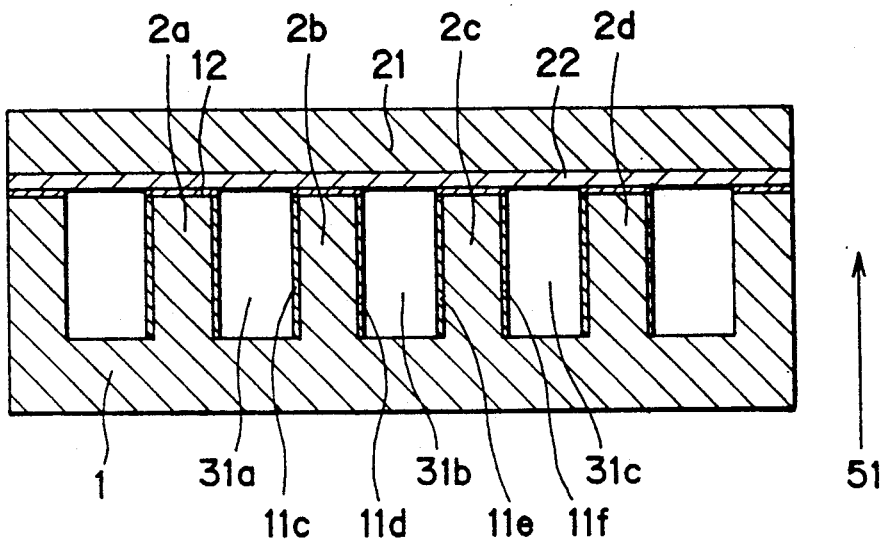
FIG. 5 is a cross-sectional view showing a part of an ejector array according to a second embodiment of the present invention.
Figure 6:
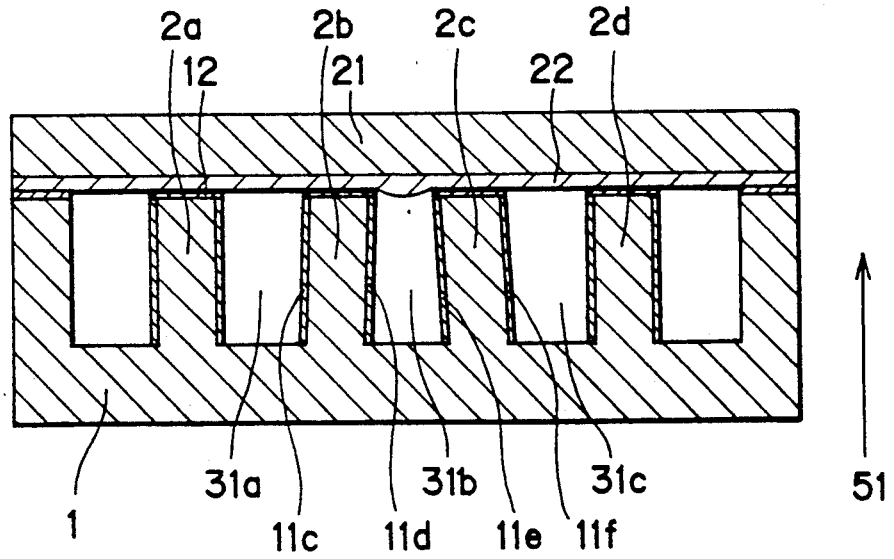
FIG. 6 is a cross-sectional view showing deformation of the ejector array shown in FIG. 5 when a driving voltage is applied thereto.

A second embodiment of the present invention will be described with reference to FIGS. 5 and 6.

In this embodiment, a lower cover plate 22 made of resin is bonded to a piezoelectric ceramic wafer 1 to cover ink channels 31*a*, 31*b*, 31*c*. An upper cover plate 21 is provided on the lower cover plate 22. The upper and lower cover plates 21 and 22 may either be bonded together with an adhesive material or be fixedly attached to each other by a mechanical means. The upper cover plate 21 is made of a material having a larger modulus of elasticity than the material of the lower cover plate 22, so that the former is largely deformable when the ribs are deformed. The restraining force of the lower cover plate 22 against the deformation of the ribs is therefore small. In addition, the lower cover plate 22 is deformed inwardly of the ink channel, the volume of the ink channel is further decreased when the volume thereof is decreased caused by the deformation of the ribs.

Figure 7:
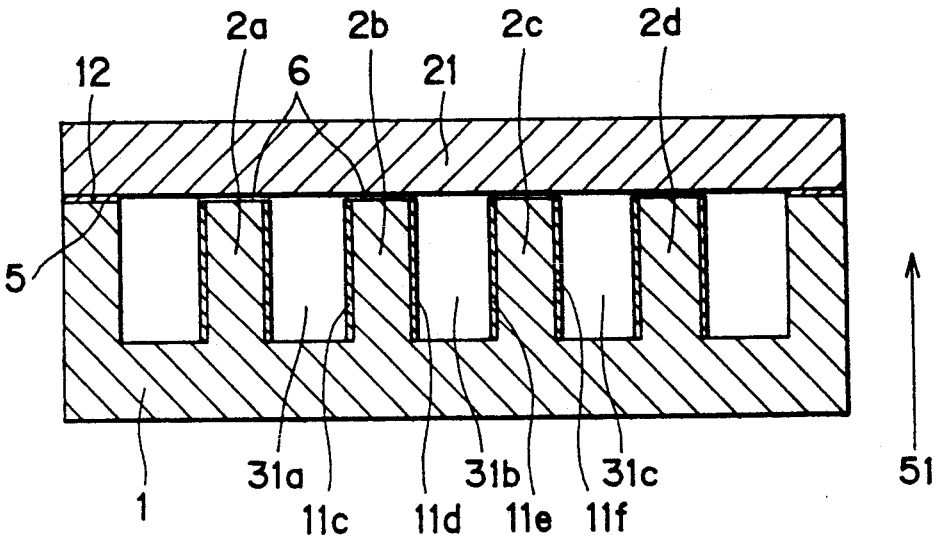
FIG. 7 is a cross-sectional view showing a part of an ejector array according to a third embodiment of the present invention.
Figure 8:
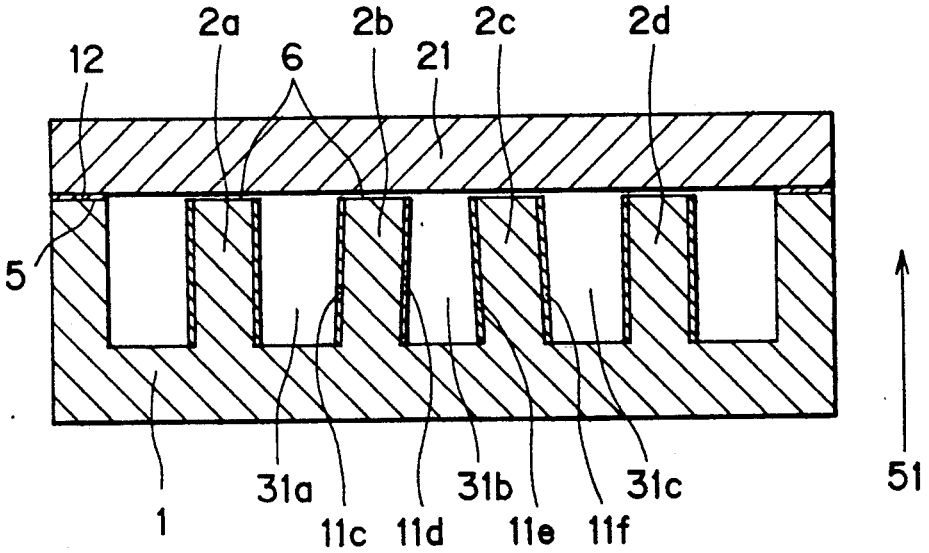
FIG. 8 is a cross-sectional view showing deformation of the ejector array shown in FIG. 7 when a driving voltage is applied thereto.

A third embodiment of the present invention will be described with reference to FIGS. 7 and 8.

In this embodiment, the ribs 2*a* through 2*d* are at equal height but are slightly lower than the leftside and rightside ribs or side walls, and a cover plate 21 is bonded to the top surfaces of side walls through an adhesive layer 5. That is, gaps 6 are provided between the top surfaces of the ribs 2*a* through 2*d* and the inner surface of the cover plate 21, which gaps extend along the ink channels. The height of the gap 6 in the vertical direction or the polarization direction 51 is equal to or less than one fifth (1/5) of the entire depth of the ink channel. The height of the gap 6 can be appropriately determined if the thickness of the adhesive layer 5 is adjusted.

The height of the gap 6 is so small that there is substantially no chance that ink contained in a particular channel is flowed into adjacent ink channels when the ink pressure in that channel is increased resulting from the deformation of the associated ribs. As such, the presence of the gap 6 does not substantially influence on the ejection of the ink droplets. Since the gaps 6 are provided along the entire path length of the ink channels, the ribs 2*a* through 2*d* are free from restraining forces which may otherwise be exerted on the ribs by the cover plate 21 if the plate is bonded to the ribs 2*a* through 2*d*.

Although the present invention has been described with respect to specific embodiments, it will be appreciated by one skilled in the art that a variety of changes may be made without departing from the scope of the invention. For example, certain features may be used independently of others and equivalents may be substituted all within the spirit and scope of the invention. For example, in lieu of employing the cover plate 21 having a corrugated cross-section as in the first embodiment, a plastically deformable flat cover plate 21 may be bonded to the piezoelectric ceramic layer and it may be shaped as shown in FIG. 3 by applying a liquid pressure to the cover plate from above.

The piezoelectric ceramic wafer 1 may be polarized in a direction opposite to the direction 51. Further, a modification can be made so that ejection of the ink droplet and supplement of ink are performed reversely in relation to the application of the voltage to the metal electrodes. In the reversed mode, the ribs 2b, 2c are deformed outwardly of the ink channel 31b pursuant to piezoelectric thickness shear effect. The outward deformation of the ribs 2b, 2c causes the volume of the ink channel 31b to increase and to thus decrease the ink pressure, whereby the ink is supplemented into the ink channel from the ink reservoir. When the voltage application is stopped, the ribs are restored to the original states, causing to increase the ink pressure and to thus eject the ink droplet from the orifice.

As described, according to the ink droplet ejection device of the present invention, ink droplet ejection can be implemented with a low voltage application.

What is claimed is:

1. An ink droplet ejection device comprising:

a piezoelectric transducer having a surface formed with a plurality of ribs spaced apart defining a plurality of grooves therebetween, the transducer being actuatable by electrodes, which create an electric field to deform the plurality of ribs; and a plate member attached to the surface of said piezoelectric transducer to cover the plurality of grooves and define a plurality of ink channels, each of said ink channels having a volume and containing ink, the volume of said ink channels being changed when corresponding ones of said plurality of ribs are deformed, wherein said plate member flexes in response to a deformation of any one of said plurality of ribs so as not to restrain said deformation, wherein said ribs are polarized in a direction perpendicular to said plate member, and said plate member has a plurality of portions corresponding to respective ones of said plurality of grooves, said portions being curved inwardly of each of said ink channels and readily inwardly buckling in response to said change in volume of said ink channels resulting from said deformation of associated ribs.

2. The array according to claim 1, wherein said plate member is a dual plate structure comprising a first plate element having a first surface bonded to the surface of said piezoelectric transducer to cover the grooves and a second surface, and a second plate element having a surface fixedly attached to the second surface of said first plate element.

3. The array according to claim 2, wherein said first plate element is made of a first material and said second plate element is made of a second material, the first material having a modulus of elasticity lower than a modulus of elasticity of the second material of said second plate member.

4. An ink droplet ejection device comprising:

a piezoelectric transducer having a surface formed with a plurality of ribs spaced apart defining a plurality of grooves therebetween, the transducer being actuatable by electrodes, which create an electric field to deform the plurality of ribs; and a plate member attached to the surface of said piezoelectric transducer to cover the plurality of grooves and define a plurality of ink channels, each of said ink channels having a volume and containing ink, the volume of said ink channels being changed when corresponding ones of said plurality of ribs are deformed, wherein said plate member flexes in response to a deformation of any one of said plurality of ribs so as not to restrain said deformation, wherein said piezoelectric has side walls having a height higher than a height of said plurality of ribs, and said plate member is fixedly attached to the side walls of said piezoelectric transducer to provide a space between each one of the plurality of ribs and said plate member.

5. The array according to claim 4, wherein a height of the space is at most one fifth of a full height of each of the ink channels.

* * * * *